US006690279B1

(12) United States Patent
Ruhrig et al.

(10) Patent No.: US 6,690,279 B1
(45) Date of Patent: Feb. 10, 2004

(54) SECURITY ELEMENT FOR THE ELECTRONIC SURVEILLANCE OF ARTICLES

(75) Inventors: Manfred Ruhrig, Weinheim (DE); David Stocks, Melbourn (GB); Hubert A. Patterson, Boca Raton, FL (US); Gregory N. Mears, Boca Raton, FL (US)

(73) Assignees: Meto International GmbH, Hirschorn (DE); Sensormatic Electronics Corp., Boca Raton, FL (US)

( * ) Notice: Subject to any disclaimer, the term of this patent is extended or adjusted under 35 U.S.C. 154(b) by 0 days.

(21) Appl. No.: 09/493,932

(22) Filed: Jan. 28, 2000

Related U.S. Application Data

(63) Continuation of application No. PCT/EP98/04596, filed on Jul. 22, 1998.

(51) Int. Cl.[7] ..... G08B 13/14

(52) U.S. Cl. ..... 340/572.6; 340/572.1; 148/108

(58) Field of Search ..... 340/572.6, 572.1, 340/572.2, 573.3, 572.4, 572.5, 568.1, 571; 148/108; 235/493

(56) References Cited

U.S. PATENT DOCUMENTS

| | | | | |
|---|---|---|---|---|
| 4,581,524 A | | 4/1986 | Hockman et al. | 235/493 |
| 4,743,890 A | | 5/1988 | Hilzinger et al. | 340/551 |
| 4,940,966 A | | 7/1990 | Pettigrew et al. | 340/551 |
| 4,960,651 A | | 10/1990 | Pettigrew et al. | 428/607 |
| 4,980,670 A | * | 12/1990 | Humphrey et al. | 340/551 |
| 5,204,526 A | * | 4/1993 | Yamashita et al. | 235/493 |
| 5,519,379 A | * | 5/1996 | Ho et al. | 340/551 |
| 5,565,847 A | | 10/1996 | Gambino et al. | 340/572 |
| 5,831,532 A | * | 11/1998 | Gambino et al. | 340/572.1 |
| 5,835,016 A | * | 11/1998 | Ho et al. | 340/568.1 |
| 6,259,368 B1 | * | 7/2001 | Ruhrig | 340/572.6 |
| 6,307,474 B1 | * | 10/2001 | Lian et al. | 340/572.6 |
| 6,441,737 B1 | * | 8/2002 | Antonenco et al. | 340/572.1 |

FOREIGN PATENT DOCUMENTS

| | | |
|---|---|---|
| EP | 123 557 | 10/1984 |
| EP | 226 812 | 7/1987 |
| EP | 295 085 | 12/1988 |

OTHER PUBLICATIONS

Patent Abstract of Japan. Ikeda Takashi, Dec. 1994. vol. 095, No. 003,4/28 1995 (publication No. JP06348880—Unitika Ltd.).

* cited by examiner

*Primary Examiner*—Nina Tong
(74) *Attorney, Agent, or Firm*—Pennie & Edmonds LLP

(57) ABSTRACT

The invention is directed to a security element for the electronic surveillance of articles. This security element is detected by surveillance systems operating in different frequency ranges and it includes at least two materials of high permeability which, when excited by an external alternating magnetic field emit each a characteristic signal. The maximum signal components of the two materials lie in different frequency ranges and the signal components of the one material are negligibly ow in that particular frequency range in which the signal component of the other material is at a maximum level. The invention also relates to surveillance systems that incorporate these security elements.

27 Claims, 8 Drawing Sheets

SECURITY ELEMENT FOR THE ELECTRONIC SURVEILLANCE OF ARTICLES

CROSS REFERENCE TO RELATED APPLICATION

This is a continuation of PCT application PCT/EP98/04596 filed Jul. 22, 1998, the content of which is expressly incorporated herein by reference thereto.

TECHNICAL FIELD

This invention relates to a security element for the electronic surveillance of articles.

BACKGROUND

Security elements in the form of soft magnetic strip material are frequently used in department stores for the protection of merchandise against pilferage. To accomplish a sufficiently high detection rate, sophisticated methods are employed which reduce the risk of false alarms effectively. Thus, it is known from EP 123 586 B to emit into the interrogation zone, in addition to two interrogation fields with the frequencies f1 and f2 in the kilohertz range, a field with a frequency in the hertz range. The two interrogation fields with the frequencies f1 and f2 excite a security element present in the interrogation zone to remit a characteristic signal with the intermodulation frequencies $n \cdot f1 \pm m \cdot f2$ (where n, m=0,1,2, . . . ). The low-frequency interrogation field has the effect of driving the security element from saturation in one direction to saturation in the other direction at the clock rate of this particular field. As a result, the characteristic signal occurs cyclically with the frequency of the low-frequency field.

As an alternative solution of a system referred to as a harmonic detection system, it has further become known to use only one interrogation field in the kilohertz range for excitation of the security element, with the characteristic signal of the security element occurring again at the clock rate of a low-frequency field cycling the soft magnetic material between the two states of saturation.

For purposes of evaluation, the shape of the characteristic signal is subsequently compared with a predetermined signal shape. If the two coincide, this is interpreted as the unauthorized presence of a protected article in the interrogation zone; an alarm is then produced indicating to sales staff that a theft has occurred.

The hysteresis loops of security elements manufactured from a soft magnetic material follow an essentially linear course between the two states of saturation. In addition, security elements have become known whose hysteresis loops exhibit an abrupt transition between the two saturation states as soon as an external magnetic field compels them to change their saturation direction. Materials showing discontinuities between the two states of saturation are referred to as "materials with Barkhausen effect". They are characterized by high permeability already in the low-frequency range, which means that they are excited to emit a characteristic signal by low-frequency interrogation fields. Further, the characteristic signals of Barkhausen materials feature a sharp peak. This again means that a relatively large signal component occurs in high-order harmonics.

Materials of this type are manufactured by subjecting soft magnetic materials to a suitable annealing process. The properties of these materials and the physical principles of the Barkhausen effect are described in detail in U.S. Pat. No. 4,660,025 and also in EP 0 448 114 A1. In particular, these prior-art specifications make reference to how soft magnetic material can be subjected to special physical treatment to turn into a material with high Barkhausen effect.

Security elements utilizing the Barkhausen effect differ significantly from soft magnetic security elements as regards their signal shape. As a direct consequence thereof, the probability of their being detected in so-called harmonic systems is relatively low soft magnetic security elements, in turn, are difficult to detect in systems designed for the detection of security elements utilizing the Barkhausen effect. The situation is different if it is aimed to have a security element detected in both a harmonic and a Barkhausen surveillance system. Where both types of security element, that is one employing soft magnetic and one employing Barkhausen material, are combined for integration into one security element, these may, under circumstances, influence each other through their magnetic fields such that the intermodulation signal of the combined security element is detectable neither in a harmonic nor in a Barkhausen surveillance system Another prior art reference, U.S. Pat. No. 5,565,847 describes a tag which has a plurality of resonating sections each having separate frequencies of excitation. Each of the strips has the same material in different lengths in order to achieve different oscillating frequencies. This is to provide a multi-bit tag.

According to EP 0 295 085 A1, an anti-pilferage tag is disclosed which uses different ferromagnetic material compositions and in particular a combination of hard or semi-hard magnetic material with a soft magnetic material. The hard or semi-hard magnetic material acts as a clamp which holds the soft material in a fixed magnetic state to give rise to a specific response to an interrogating field.

There still remains a need for improvements in this area, and the present invention provides one such solution to these problems.

SUMMARY OF THE INVENTION

The present invention relates to a security element which is detected by surveillance systems operating in different frequency ranges. This security element comprises at least two materials of high permeability which, when excited by an external alternating magnetic field, emit each a characteristic signal; the maximum signal components of the two materials lie in different frequency ranges. Further, the signal components of the one material are negligibly low in that particular frequency range in which the signal component of the other material is at a maximum level.

According to an advantageous further feature of the security element of the present invention, the physical properties of the two materials are coordinated such that the component of the characteristic signal of the one material is negligibly low in that particular frequency range in which the signal component of the characteristic signal of the other material is at a maximum level.

Another solution of the present invention provides for the security element to be comprised of a material with Barkhausen effect (high permeability; low coercive force in the frequency range (F1), high coercive force in the frequency range (F2), where F2>>F1), which material is excited by an external magnetic field to emit a characteristic signal detectable in a surveillance system (S1), and of a soft magnetic material (high permeability; low coercive force in the frequency range (F2)) which, when an alternating magnetic field is applied, is excited to emit a characteristic signal detectable in a surveillance system (S2). Further, the physical properties of the two materials are coordinated such that the intensity of the characteristic signal (signal 2) of the soft magnetic material is negligibly low in the detection range (F1) of the surveillance system (S1), while it attains its maximum level in the detection range (F2) of the surveillance system (S2), and that the intensity of the characteristic signal (signal 1) of the material with Barkhausen effect attains a maximum level in the detection range (F1) of the surveillance system (S1), while it is negligibly low in the detection range (F2) of the surveillance system (S2).

BRIEF DESCRIPTION OF THE DRAWINGS

The present invention will be described in more detail in the following detailed description with reference to the accompanying drawings, wherein:

FIG. 4 is a schematic view of the characteristic signals in a Barkhausen surveillance system, in which:

FIG. 5 is a schematic view of the characteristic signals in a harmonic surveillance system, in which:

FIG. 6 is a schematic view of the characteristic signals in a harmonic surveillance system with two high frequency interrogation fields and one low-frequency interrogation field, in which:

DETAILED DESCRIPTION OF THE PREFERRED EMBODIMENTS

Figure 1A:
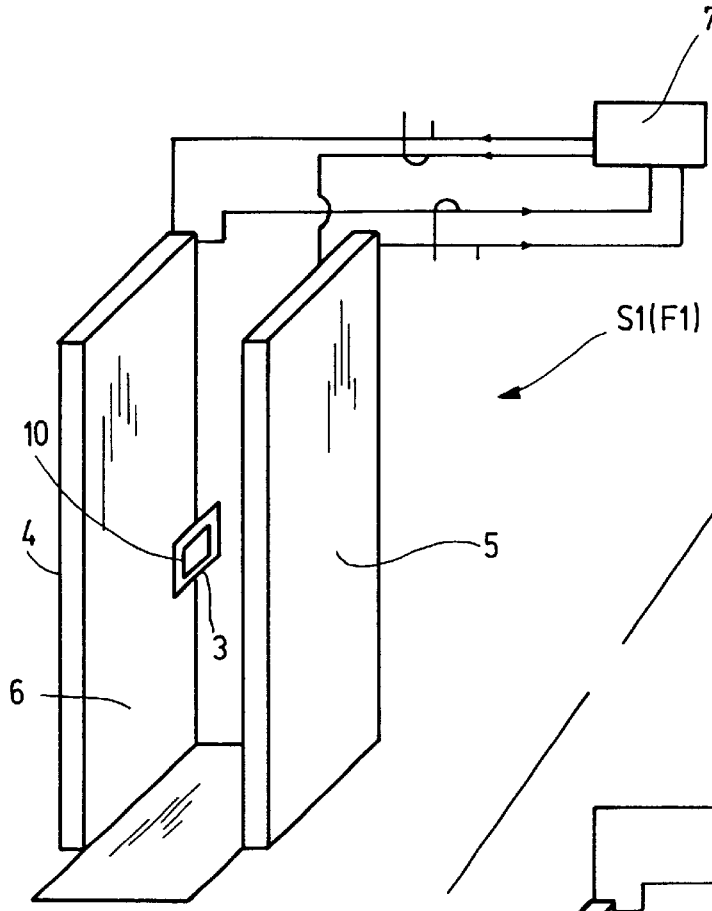
FIG. 1*a* is a perspective view of a Barkhausen surveillance system.

Physical properties with respect to the Barkhausen security elements are understood to mean that the material is optimized by its outer shape, by annealing, or by inducing mechanical stress. With respect to the soft magnetic material, such variation of the physical properties, for example, in cases where strip elements are used, means an adjustment of the length and thus of the demagnetizing factor of the strip elements.

In an advantageous feature of the security element of the invention, the two materials are present in the form of a thin film and/or a strip and/or a wire and/or a foil. Conveniently, the two materials are utilized in like shape.

As mentioned in the foregoing, optimization of the frequency response of the materials utilized is effected by a variation of their physical properties. As a preferred further feature, it is generally proposed to dimension the bulk components of the two materials such that their signal components in the respective other surveillance system are negligibly low.

A still further optimization may be accomplished by a suitable relative arrangement of the materials. Preferably, this relative arrangement is selected such that coupling via their magnetic fields is as low as possible. The simplest procedure would be to select the relative distance of the Barkhausen security element and the soft magnetic security element to be correspondingly large. This, however, entails the disadvantage that it is necessary for the combined security element to be of large dimensions, which one generally wishes to avoid for cost reasons. Optimization within the meaning of the invention rather means seeking a compromise between minimum interaction and maximum possible detection rate in systems designed to operate in different frequency ranges for the detection of characteristic signals.

According to an advantageous further feature of the security element of the invention, it is proposed to provide the materials with an elongated shape and to align them parallel to each other. This enables the manufacture of security elements having relatively little lateral extent.

Where the size of the security elements plays a secondary role, it is possible in cases where two materials are used to arrange them at any desired relative angle ($\alpha$). In an optimum arrangement, the two materials are arranged at right angles to each other, because then mutual interference equals zero.

It has proven to be particularly suitable if the magnetostriction of the materials utilized is low.

According to an advantageous further feature of the of the invention the security element offers the possibility for deactivation. This is achieved by adding a semihard or hard magnetic material, preferably in the form of a lamina or laminas, to at least one of the two materials. Deactivation is then achieved by magnetizing the semi hard or hard magnetic material to a level high enough to prevent the soft magnetic material and/or the material with the strong Barkhausen effect from generating a characteristic signal within the interrogation field.

If only one of the two materials is made deactivatable, for instance the soft magnetic component, optimum detection could be achieved in the other type of surveillance systems, in this case the Barkhausen system, and vice versa. If both materials are combined with a semi hard or hard magnetic component, the security element could be deactivated for either type of surveillance system. In a preferred embodiment of the present invention, the semi-hard or hard magnetic components differ in at least one of their magnetic properties, for instance in their coercive field levels. This allows one to chose between optimum detection in either system on one hand and optimum compatibility on the other.

Figure 1B:
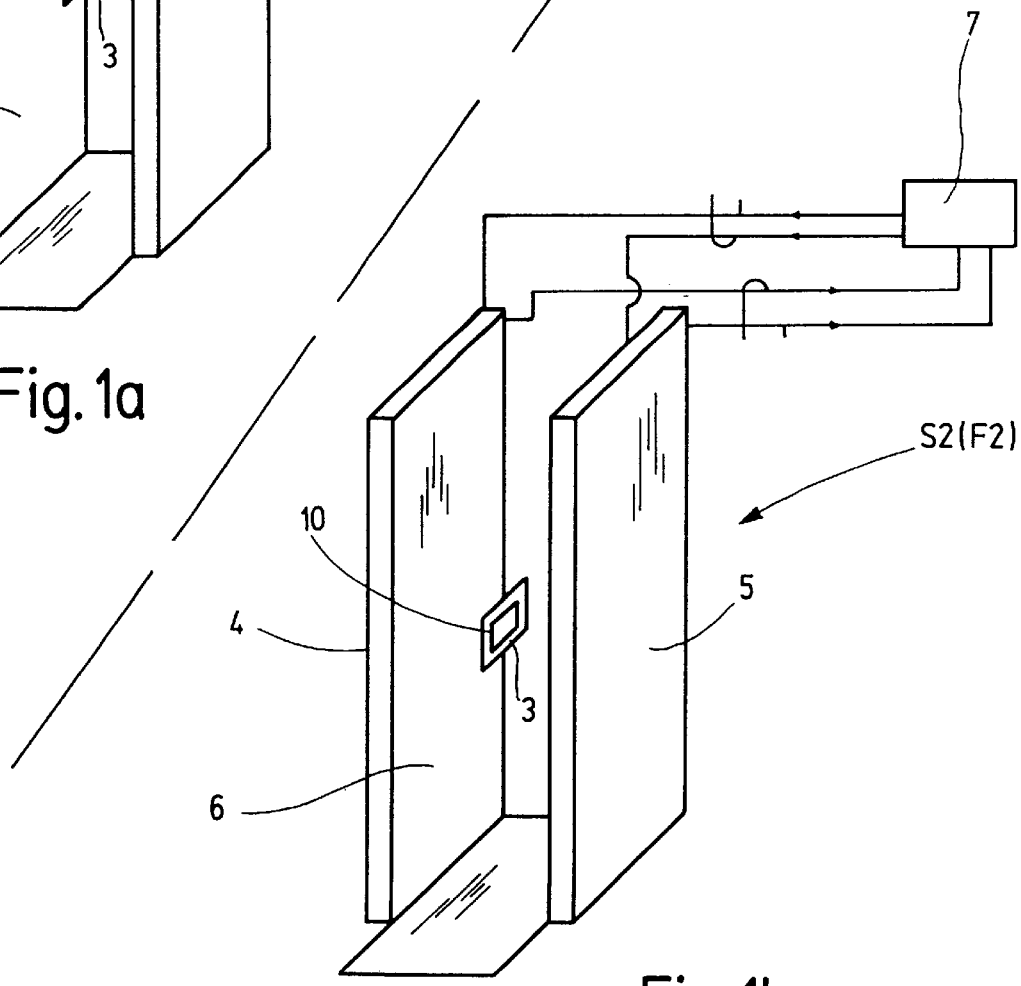
FIG. 1*b* is a perspective view of a harmonic surveillance system.

Referring now to FIG. 1*a* of the drawings, there is shown a perspective representation of a surveillance system S1 for Barkhausen security elements, while FIG. 1*b* shows a perspective representation of a harmonic surveillance system S2. Both surveillance systems bear great resemblance to each other as regards their structure and their mode of operation in general. The differences lie merely in the detail.

The transmitting device 4 emits an interrogation field H into the zone 6 to be protected. The Barkhausen security element 1 and the soft magnetic security element 2 are excited by the interrogation field H to emit a characteristic signal. While the interrogation frequency of the Barkhausen surveillance system S1 is in the low-frequency range (at 70 hertz, for example), the interrogation frequency of the harmonic system S2 lies in the kilohertz range. As set forth above, the high-frequency interrogation frequency in harmonic surveillance systems may also be modulated by a low-frequency interrogation frequency.

The characteristic signal is detected by the associated receiving device 5 and transmitted to the computing/control unit 7. This unit evaluates the signal in accordance with a predetermined algorithm, releasing, where applicable, an alarm to indicate the unauthorized presence of a protected article 10 in the interrogation zone 6.

Figure 2:
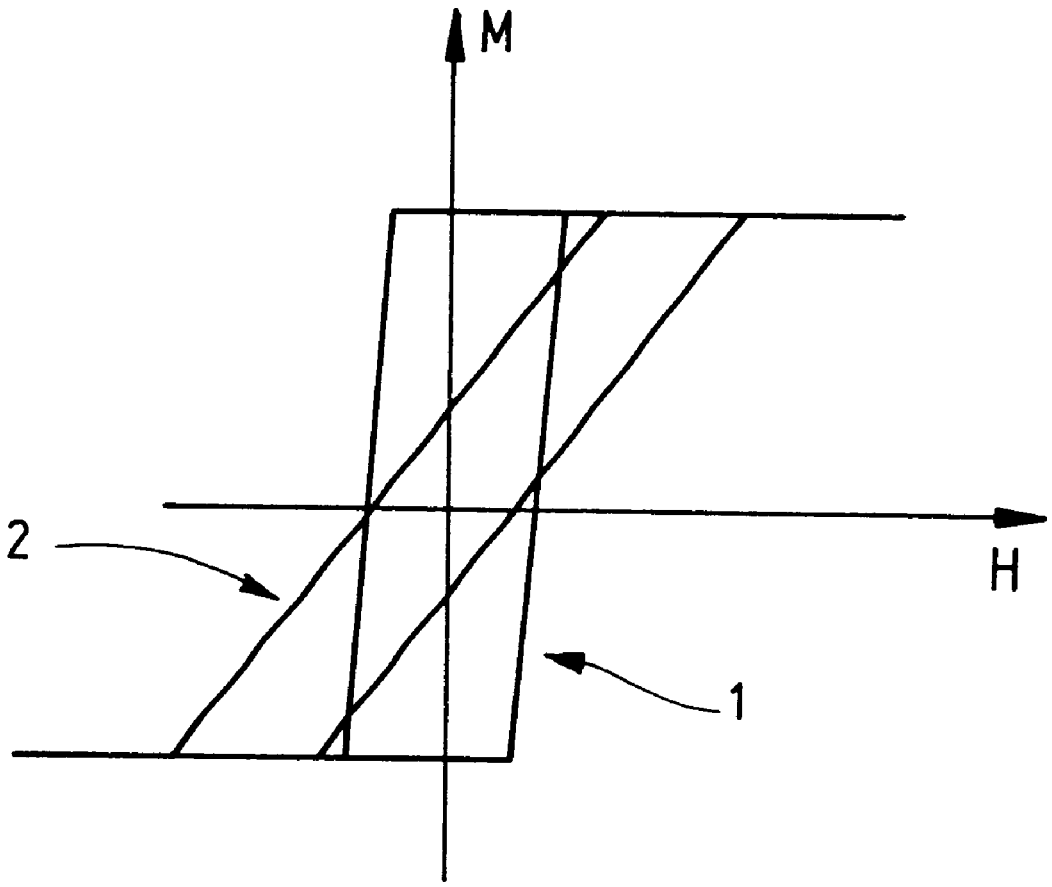
FIG. 2 is a view of the hysteresis loops of soft magnetic material and of material with high Barkhausen effect.

In FIG. 2, the static hysteresis loops of a soft magnetic material 2 and of a material 1 having a high Barkhausen effect are plotted in the conventional H-M diagram. While the hysteresis loop of the soft magnetic material 2 exhibits linear continuities between the two opposite states of magnetization, the material 1 having the high Barkhausen effect shows discontinuities at a relatively low field strength H.

Figure 3A:
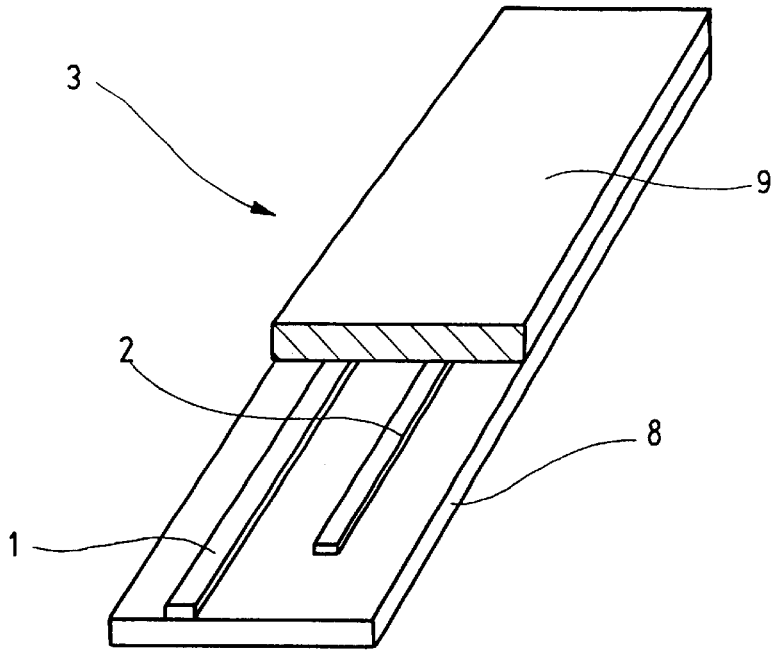
FIG. 3*a* is a view of an advantageous design of the security element of the present invention.
Figure 3B:
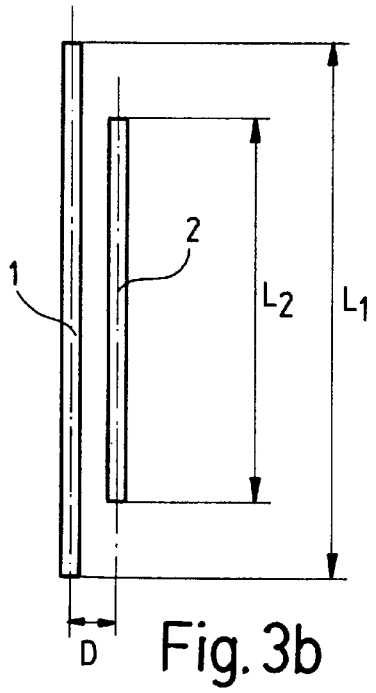
FIG. 3*b* is a detail view of the design of FIG. 3*a;*

FIG. 3*a* shows an advantageous design of the security element 3 of the present invention. Two strip members are arranged on a substratum 8. While the one strip member is made of a material 1 having a high Barkhausen effect, the other is fabricated from a soft magnetic material 2. The two strip members 1, 2 are arranged parallel to each other. They are covered by a layer 9 suitable for being printed upon. FIG. 3*b* shows the two strip members 1, 2 without the substratum 8 and without the print layer 9.

The physical properties of the two strip members 1, 2 (lengths (L1, L2), permeability and coercive force, bulk components, etc.), and the relative distance (D) of the two members 1, 2 are dimensioned such that the characteristic signals of the two security elements 1, 2 are varied only insignificantly by the effect of the other security element 2, 1, respectively. Therefore, the security element 3 of the invention is detected equally reliably by both surveillance systems S1, S2.

Figure 3C:
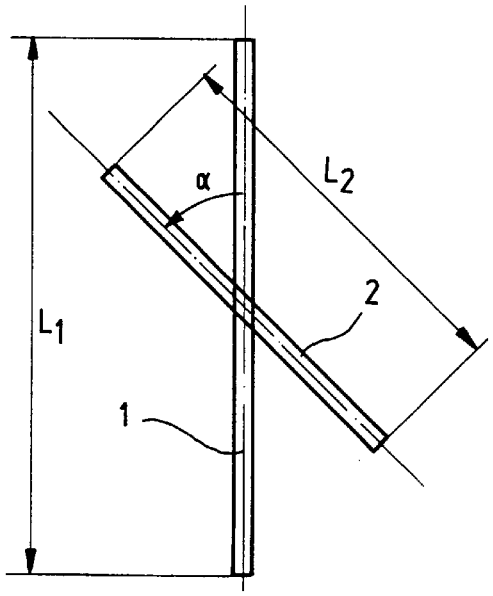
FIG. 3*c* is a view of a further design of the security element of the present invention.

FIG. 3*c* shows an alternative design of the security element 3 of the present invention. The two strip members 1, 2 intersect at an angle $\alpha$. In an optimum arrangement, this angle $\alpha$ amounts to 90 degree. In such an arrangement, mutual interference of the magnetic fields of the two security elements 1, 2 is zero. This is achieved, however, at the expense of a correspondingly large dimension of the security element 3 which does not appear acceptable for any application due to cost considerations.

Figure 3D:
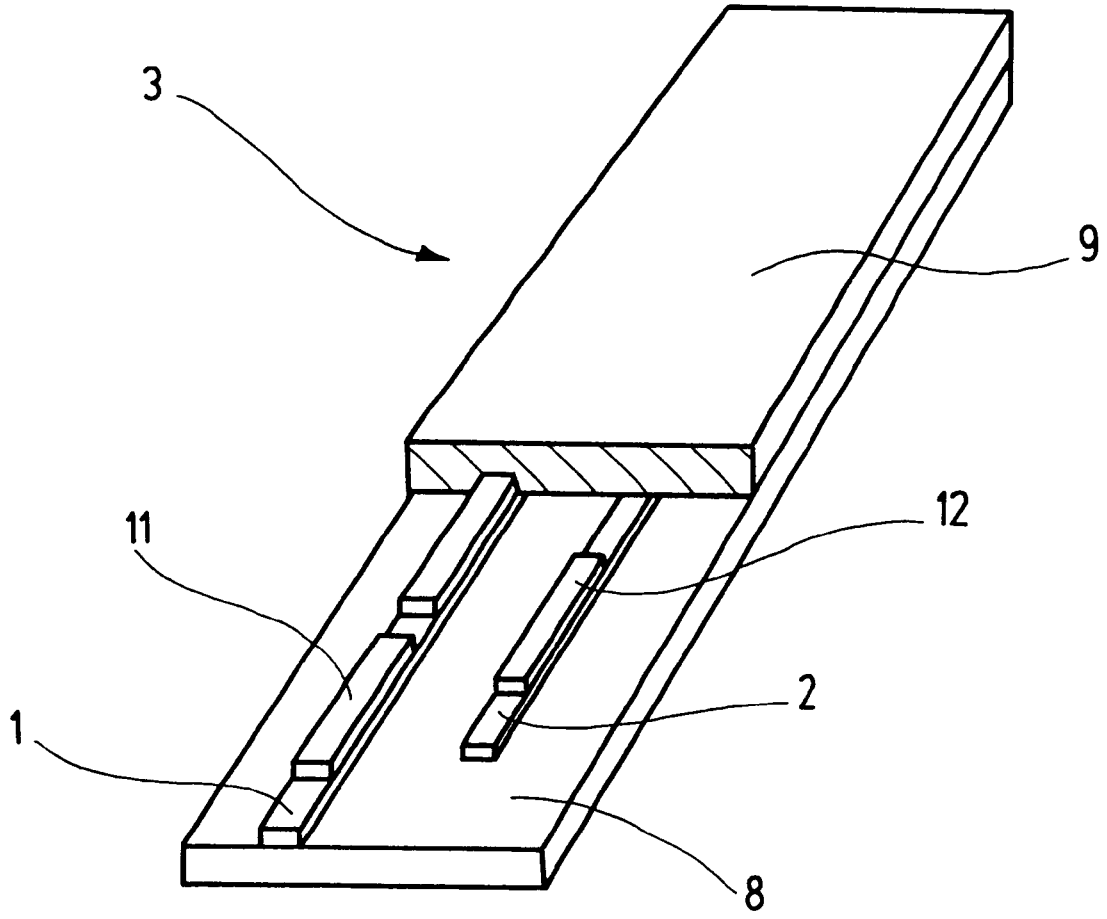
FIG. 3*d* is a design for a deactivatable version of the security element of the present invention.

FIG. 3*d* shows a deactivatable version of the security element 3 of the present invention. The Barkhausen material 1 and the soft magnetic material 2 are combined with a semi-hard and/or hard magnetic material 11; 12.

Figure 4A:
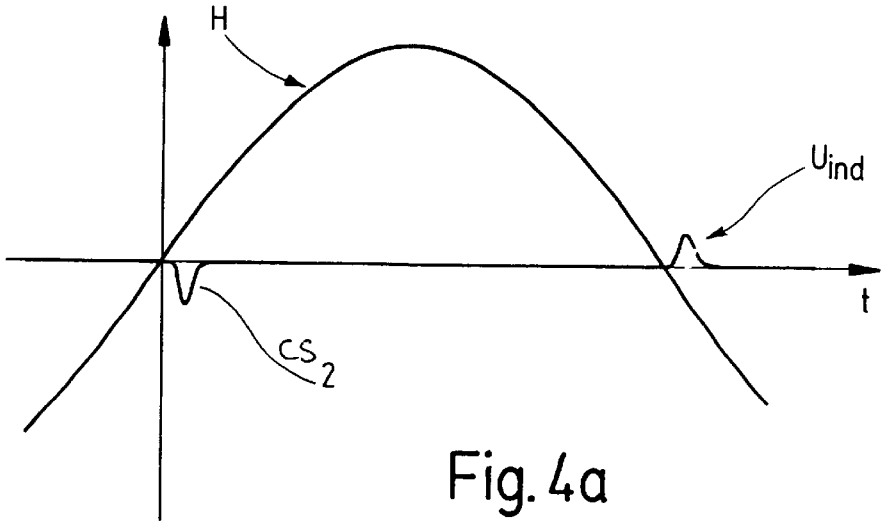
FIG. 4*a* shows the characteristic signal of the soft magnetic material.
Figure 4B:
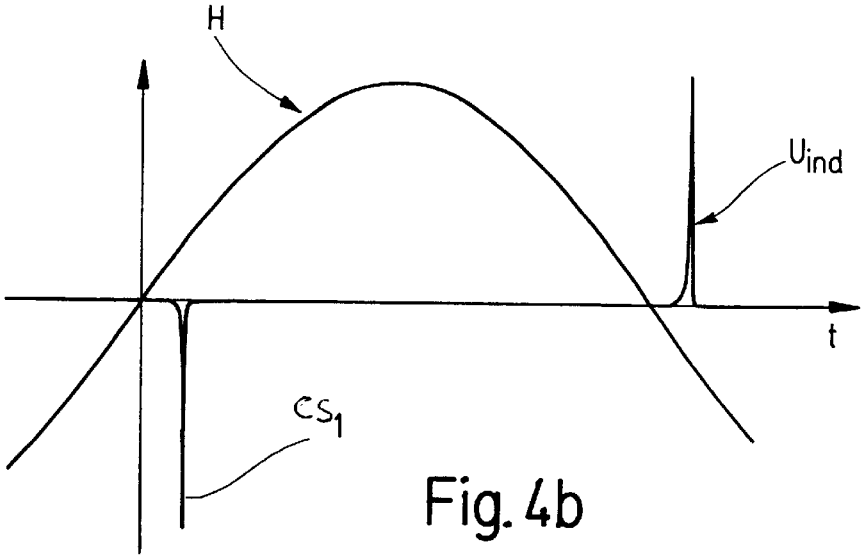
FIG. 4*b* shows the characteristic signal of the Barkhausen material.
Figure 4C:
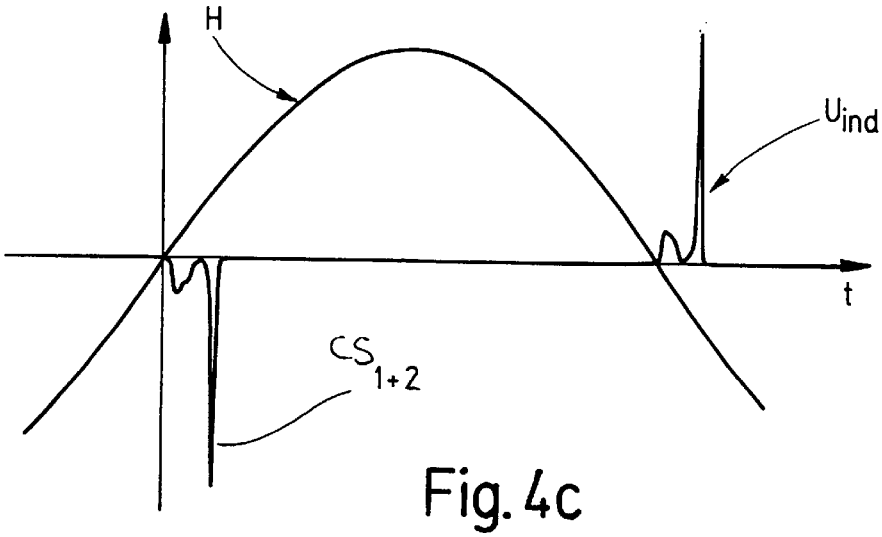
FIG. 4*c* shows the characteristic signal of a security element of the present invention.

The subsequent FIGS. 4, 5 and 6 illustrate clearly by way of time charts the effect achieved by the security element 3 of the present invention in the different surveillance systems S1, S2. FIG. 4 relates to the signals produced by a soft magnetic security element 2 (FIG. 4*a*), a Barkhausen security element 1 (FIG. 4*b*), and the security element of the invention (FIG. 4*c*) in a Barkhausen surveillance system S1. The sinusoidal curve in these figures indicates the interrogation frequency of the interrogation field H which, in the event of a Barkhausen surveillance system S1, lies in the low-frequency range, for example, at 70 hertz. On a reversal of the magnetization state, the security element 1, 2, 3 emits a characteristic signal CS inducing a voltage $U_{ind}$ in the receiving device 5. The computing/control unit 7 identifies a received signal as a characteristic signal, producing an alarm. As FIG. 4*a* shows, the signal component CS2 produced by a soft magnetic material 2 in a Barkhausen surveillance system S1 is relatively small, while the Barkhausen security element 1 in the Barkhausen surveillance system S1 generates a sharp peak CS1. If there were mutual interference of the two security elements 1, 2 in an uncontrolled way, the resultant intermodulation signal would materially differ from the typical peak shape which stems from a Barkhausen security element 1 operating without disturbance. In consequence, the risk increases for the Barkhausen surveillance system S1 to be unable to identify a "simple" combination of Barkhausen security element 1 and soft magnetic security element 2 as a security element per se, accordingly failing to activate an alarm. Attendant upon this is a material reduction of the detection probability.

This risk is nearly eliminated by the security element 3 of the present invention. As appears clearly from a comparison of FIGS. 4*b* and 4*c*, the characteristic signal CS 1+2 the security element 3 of the invention differs only insignificantly from the characteristic signal of a conventional Barkhausen security element 1. The computing/control unit 7 of the Barkhausen surveillance system S1 will readily identify the characteristic signal of the security element 3 of the invention, consequently producing an alarm.

Figure 5A:
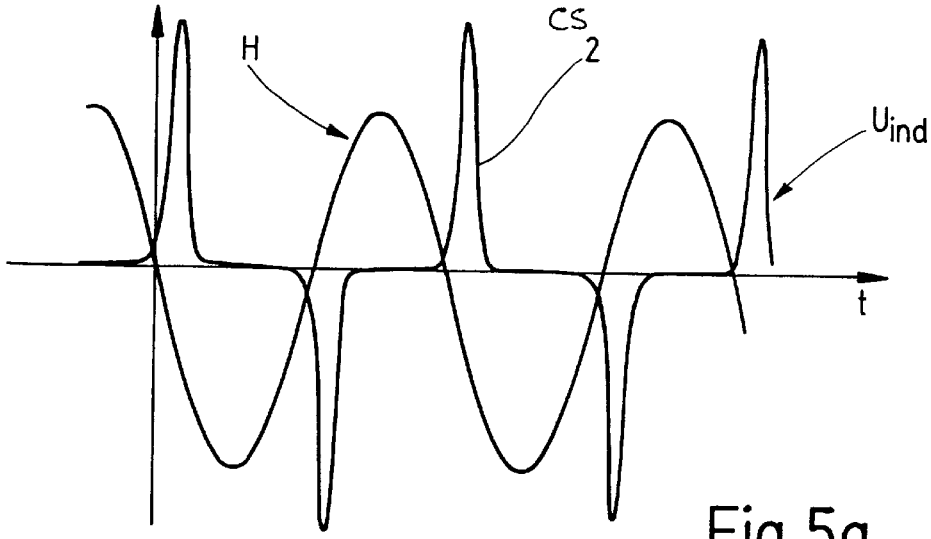
FIG. 5*a* shows the characteristic signal of the soft magnetic material.
Figure 5B:
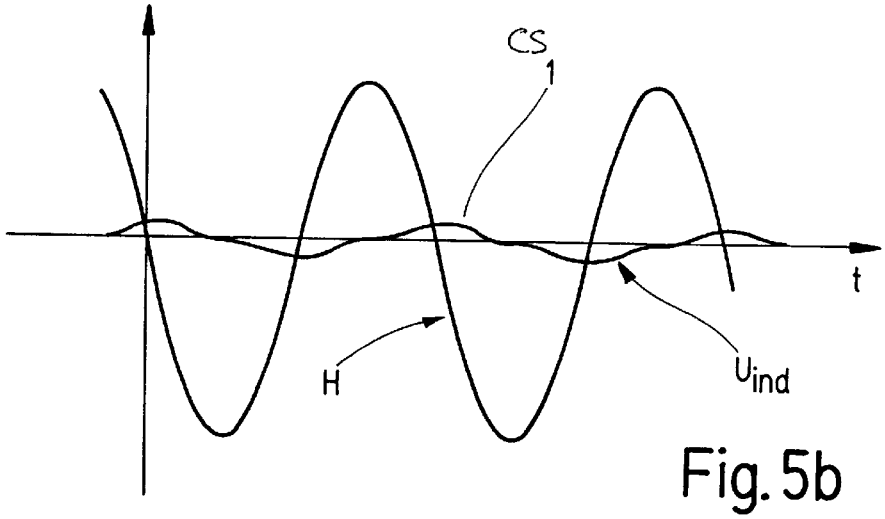
FIG. 5*b* shows the characteristic signal of the Barkhausen material.
Figure 5C:
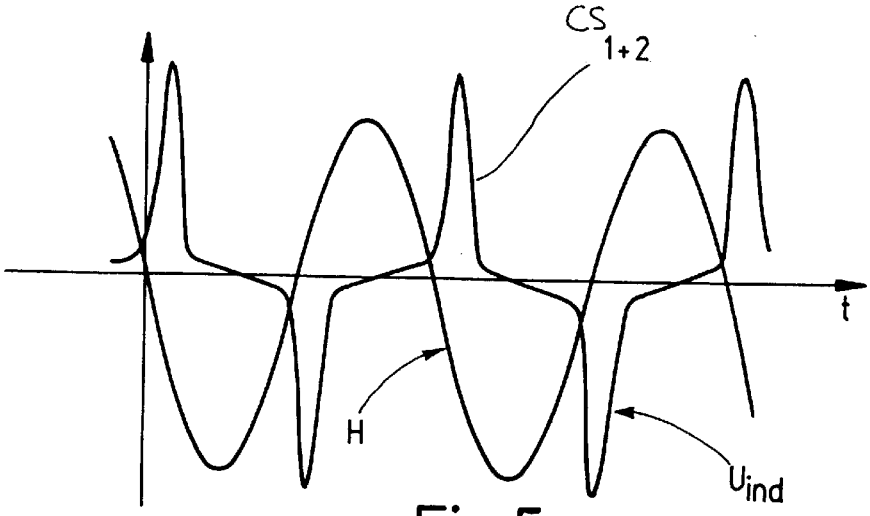
FIG. 5*c* shows the characteristic signal of a security element of the present invention.

FIG. 5 shows the analogous relationships in cases where a harmonic surveillance system S2 is utilized. The sinusoidal curve indicates again the interrogation frequency of the interrogation field H. In a harmonic surveillance system S2, this frequency is in the kilohertz range, for example, at 5 kilohertz. As becomes apparent from FIG. 5*a*, a soft magnetic security element 2 generates in the harmonic system S2 a distinctive signal CS2 which is again measured as an induced voltage $U_{ind}$ in the receiving device 5. Though being a low level signal (FIG. 5*b*), the signal of the Barkhausen security element 1 adversely affects the detection rate of the harmonic surveillance system 52 for the reasons recited in connection with the Barkhausen surveillance system 1. Again, a comparison of FIGS. 5*a* and 5*c* reveals that the shape of the characteristic signal CS 1&2 of the security element 3 of the invention differs little from the shape of the characteristic signal CS2 of a simple soft magnetic security element 2.

Figure 6A:
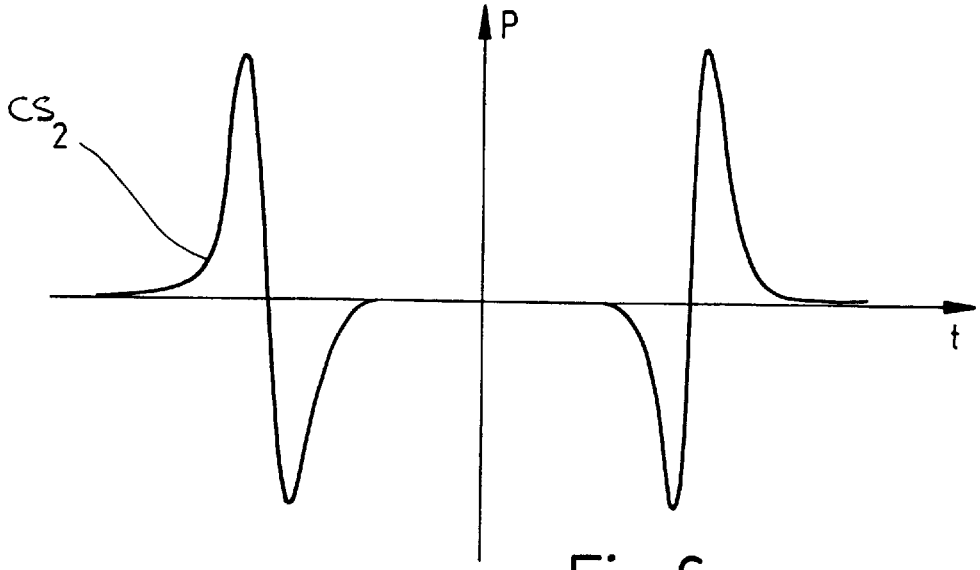
FIG. 6*a* shows the characteristic signal of the soft magnetic material.
Figure 6B:
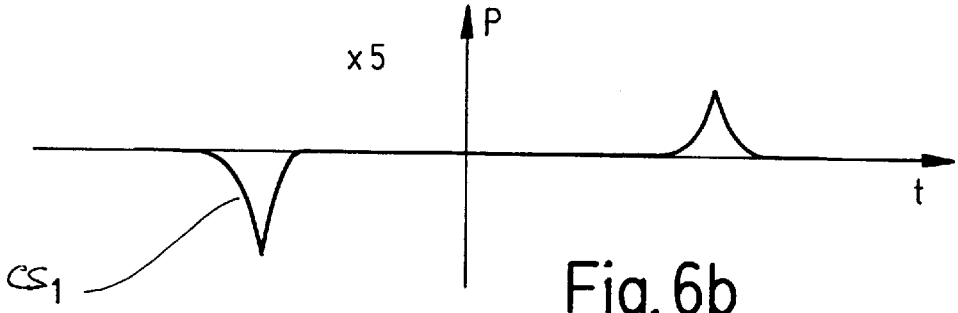
FIG. 6*b* shows the characteristic signal of the Barkhausen material.
Figure 6C:
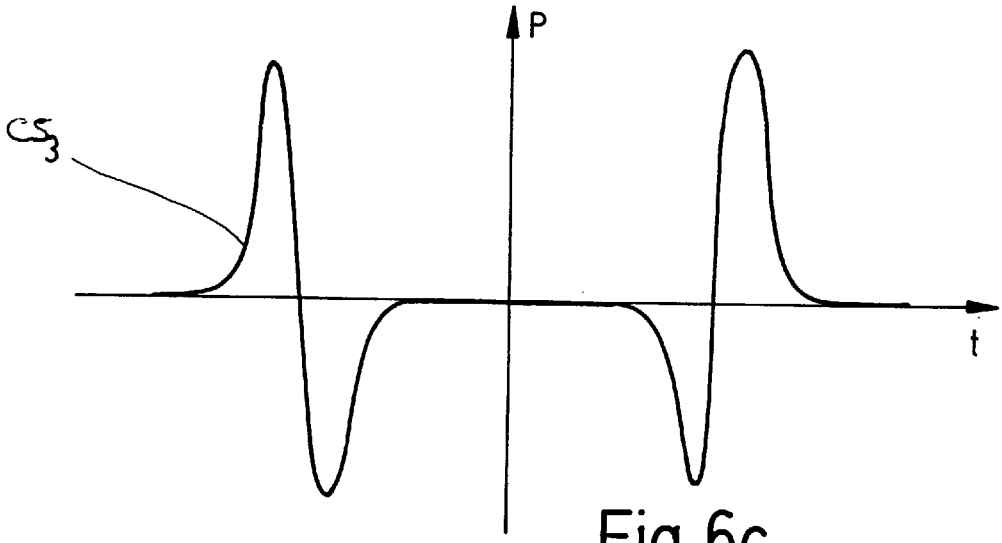
FIG. 6*c* shows the characteristic signal of a security element of the present invention.

FIG. 6 illustrates the characteristic signals of a soft magnetic security element 2 (FIG. 6*a*), a Barkhausen security element 1 (FIG. 6*b*), and the security element 3 of the invention (FIG. 6*c*) in a harmonic surveillance system S2 having two high-frequency interrogation fields f1, f2 and one low-frequency interrogation field f3. A corresponding harmonic surveillance system S2 has been presented above. Again, a comparison of FIGS. 6*a* and 6*c* reveals that the characteristic signals of the soft magnetic security element 2 and the security element 3 of the invention essentially coincide. The signal shape of the Barkhausen security element 1 (FIG. 6*b*) differs from the expected shape. The requisite high detection rate of the surveillance system is not reduced either in the use of the security element 3 of the invention.

Figure 7A:
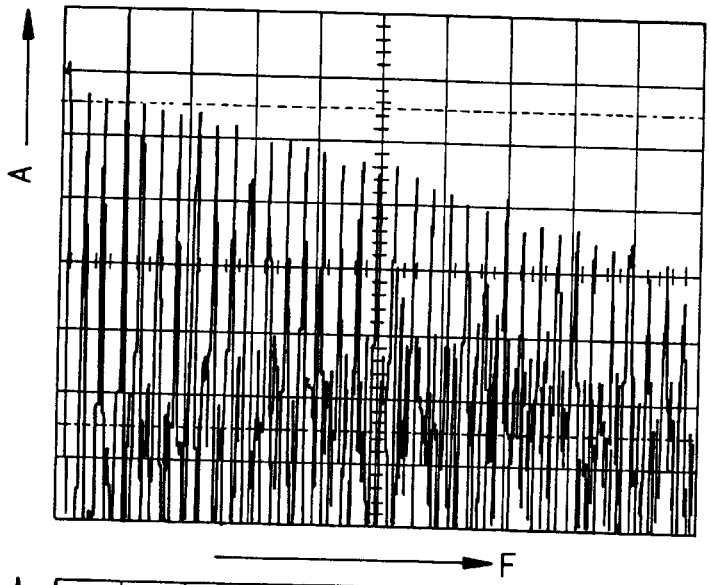
FIG. 7 is a view of the frequency spectra in a Barkhausen surveillance system of FIG. 7*a* a Barkhausen security element.
FIG. 7*b* a soft magnetic security element.
FIG. 7*c* a security element of the present invention.
Figure 7B:
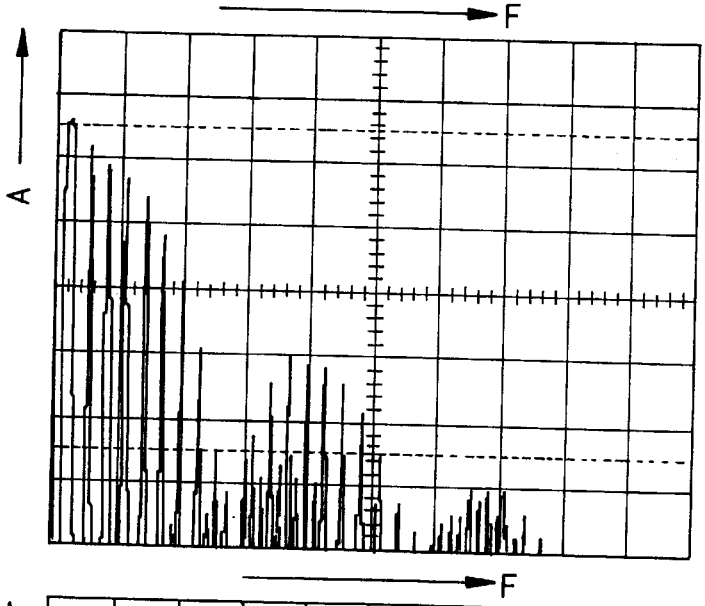
Figure 7C:
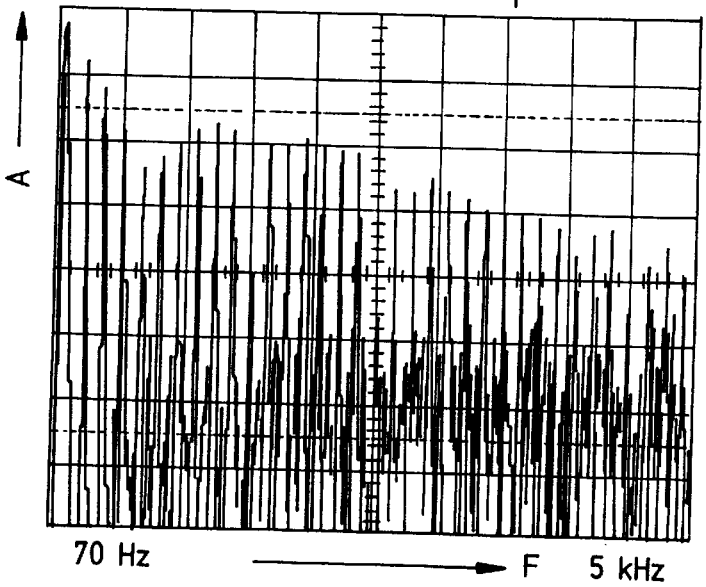

FIGS. 7*a*, 7*b* and 7*c* reflect the situation as it presents itself when the security element 3 of the invention is utilized in a Barkhausen surveillance system S1. Instead of showing signal waveforms, however, these figures show the signal frequency spectra.

FIG. 7*a* illustrates the frequency spectrum of a Barkhausen security element 1 in a Barkhausen surveillance system S1 . This frequency spectrum is characterized in that relatively large signal components of the characteristic signal occur even in the high order harmonics of the fundamental frequency (F=70 Hz).

FIG. 7*b* shows the frequency spectrum of a soft magnetic security element 2 in a Barkhausen surveillance system S1. By reason of the relatively distinct spectral difference, it is unlikely for the presence of a soft magnetic security element 2 in the Barkhausen surveillance system S1 to produce an alarm.

The situation is completely different with the frequency spectrum of the characteristic signal of the security element 3 of the invention in the Barkhausen surveillance system S1 (FIG. 7*c*). Coincidence with the Barkhausen security element 1 (FIG. 7*a*) is so high that an alarm will be produced in the Barkhausen surveillance system S1 as soon as a security element 3 of the invention appears in the interrogation zone 6.

What is claimed is:

1. A security element adapted to be detectable by first and second electronic article surveillance systems operating in different frequency ranges, comprising a first and a second materials of high permeability which, when excited by an external alternating magnetic field, each emit a characteristic signal, wherein the materials each have maximum signal component which lie in the different frequency ranges, wherein the first material has a signal component that is negligibly low in the frequency range of a second surveillance system in which the second material has a signal component at a maximum level, and wherein the second material has a signal component that is negligibly low in the frequency range of a first surveillance system in which the first material has a signal component at a maximum level.

2. The security element as claimed in claim 1, wherein the two materials have physical properties which are coordinated such that the component of the characteristic signal of the one material is negligibly low in the particular frequency range in which the signal component of the characteristic signal of the other material is at a maximum level.

3. The security element as claimed in claim 1, wherein the materials are present in the form of a film, strip, wire or foil.

4. The security element as claimed in claim 1, wherein the signal components of the two materials are determined by their respective bulk component dimensions.

5. The security element as claimed in claim 1, wherein the materials are in such relative arrangement or relative spacing such that their interaction is minimal.

6. The security element as claimed in claim 1, wherein the two materials are of an elongated shape and are aligned parallel to each other.

7. The security element as claimed in claim 1, wherein the two materials are of an elongated shape and are arranged at any angle.

8. The security element as claimed in claim 1, wherein the two materials have low magnetostriction.

9. Electronic surveillance system in combination with the security element of claim 1.

10. The security element as claimed in claim 1, wherein at least one material is combined with a semi-hard or hard magnetic material to allow deactivation.

11. The security element as claimed in claim 10, wherein the semi-hard or hard magnetic material is in the form of segments or a complete strip.

12. The security element as claimed in claim 10, wherein each of the materials is combined with a semi-hard or hardmagnetic material, whereby the semi-hard or hardmagnetic materials differ in at least one magnetic property.

13. The security element as claimed in claim 10, wherein each of the materials is combined with a semi-hard or hardmagnetic material, whereby the semi-hard or hardmagnetic materials differ in at least one magnetic property differ in their coercive field levels.

14. A security element for the electronic of articles, comprising

A) a first material having a Barkhausen effect including a high permeability, a low coercive force in a first frequency range and a high coercive force in a second frequency range, wherein the second frequency range is much greater than the first frequency range, and the first material when excited by an external magnetic field emits a characteristic signal which is detectable in a first surveillance system, and B) a soft magnetic second material having a high permeability and low coercive force in the second frequency range so that, when an alternating magnetic field is applied, the second material is excited to emit a characteristic signal detectable in a second surveillance system, wherein the two materials have physical properties which are coordinated such that the soft magnetic second material has a characteristic signal of negligibly low intensity in the detection range of the first surveillance system, but attains maximum level in the detection range of the second surveillance system, and that the first material having a Barkhausen effect provides a characteristic signal that attains a maximum intensity level in the detection range of the first surveillance system, but has a negligibly low intensity level in the detection range of the second surveillance system.

15. The security element as claimed in claim 14, wherein the materials are present in the form of a film, strip, wire or foil.

16. The security element as claimed in claim 14, wherein the signal components of the two materials are determined by their respective bulk component dimensions.

17. The security element as claimed in claim 14, wherein the materials are in such relative arrangement or relative spacing such that their interaction is minimal.

18. The security element as claimed in claim 14, wherein the two materials are of an elongated shape and are aligned parallel to each other.

19. The security element as claimed in claim 14, wherein the two materials are of an elongated shape and are arranged at any angle.

20. The security element as claimed in claim 14, wherein the two materials have low magnetostriction.

21. Electronic surveillance system in combination with the security element of claim 14.

22. The security element as claimed in claim 14, wherein at least one material is combined with a semi-hard or hard magnetic material to allow deactivation.

23. The security element as claimed in claim 22, wherein the semi-hard or hard magnetic material is in the form of segments or a complete strip.

24. The security element as claimed in claim 22, wherein each of the materials is combined with a semi-hard or hardmagnetic material, whereby the semi-hard or hardmagnetic materials differ in at least one magnetic property.

25. The security element as claimed in claim 22, wherein each of the materials is combined with a semi-hard or hardmagnetic material, whereby the semi-hard or hardmagnetic materials differ in at least one magnetic property differ in their coercive field levels.

26. A security element adapted to be detectable with a maximum response by a electronic article surveillance system operating in a first frequency range and a second electronic article surveillance system operating in a first frequency range, wherein the first and second frequency ranges are different, comprising a first material of high permeability and a having a maximum signal component when excited by the frequency range of the first electronic system; and a second material of high permeability and a having a maximum signal component when excited by the frequency range of the second electronic system;

wherein the first material has a low signal component when excited by the frequency range of the second electronic system, and the second material has a low signal component when excited by the frequency range of the first electronic system.

27. The security element of claim 26 wherein the first material exhibits a Barkhausen effect and a low coercive force in response to the first frequency range and a high coercive force in a second frequency range, wherein the second frequency range is much greater than the first frequency range, and wherein the second material has a characteristic signal of negligibly low intensity in response to the first surveillance system, and that the first material provides a characteristic signal that attains a maximum intensity level in response to the first surveillance system, but has a negligibly low intensity level in response to the second surveillance system.

* * * * *